US008096923B2

(12) United States Patent
White

(10) Patent No.: US 8,096,923 B2
(45) Date of Patent: Jan. 17, 2012

(54) EXERCISE MAT

(76) Inventor: Helene M. White, New York, NY (US)

( * ) Notice: Subject to any disclaimer, the term of this patent is extended or adjusted under 35 U.S.C. 154(b) by 79 days.

(21) Appl. No.: 12/404,576

(22) Filed: Mar. 16, 2009

(65) Prior Publication Data

US 2009/0239724 A1 Sep. 24, 2009

Related U.S. Application Data

(60) Provisional application No. 61/070,423, filed on Mar. 21, 2008.

(51) Int. Cl.
*A63B 26/00* (2006.01)

(52) U.S. Cl. ..... 482/23; 482/148

(58) Field of Classification Search ..... 482/23, 482/142, 148, 909; D21/662; D6/582
See application file for complete search history.

(56) References Cited

U.S. PATENT DOCUMENTS

| | | | | |
|---|---|---|---|---|
| 4,434,983 | A | 3/1984 | Taggart | |
| D389,642 | S | 1/1998 | Nadel | |
| 5,873,787 | A | 2/1999 | Colak | |
| 6,387,013 | B1 | 5/2002 | Marquez | |
| 6,491,196 | B1 | 12/2002 | Coler | |
| 6,640,359 | B1 | 11/2003 | Alane | |
| 6,681,416 | B1 * | 1/2004 | Yang | 4/583 |
| 6,751,816 | B1 | 6/2004 | Wechsler | |
| 6,821,210 | B2 | 11/2004 | Kallage, Jr. | |
| 7,001,318 | B2 | 2/2006 | Su-Tuan | |
| 7,007,322 | B2 | 3/2006 | Alane | |
| 7,108,635 | B2 * | 9/2006 | Howlett-Campanella | 482/23 |
| D530,512 | S | 10/2006 | Palaszek | |
| D615,337 | S * | 5/2010 | Sultan | D6/590 |
| 2001/0034288 | A1 | 10/2001 | Howlett-Campanella | |
| 2002/0142888 | A1 | 10/2002 | Marques | |
| 2003/0017915 | A1 * | 1/2003 | Prinzmetal | 482/23 |
| 2005/0034241 | A1 * | 2/2005 | Prince et al. | 5/690 |
| 2006/0073305 | A1 | 4/2006 | Kole | |
| 2006/0160672 | A1 * | 7/2006 | Appleby | 482/84 |
| 2007/0088232 | A1 | 4/2007 | Corradini | |
| 2007/0275827 | A1 * | 11/2007 | Glaser | 482/23 |
| 2007/0287002 | A1 * | 12/2007 | Cabados | 428/319.3 |
| 2008/0096183 | A1 | 4/2008 | Cotran et al. | |
| 2009/0255060 | A1 * | 10/2009 | Biggs | 5/417 |
| 2010/0048356 | A1 * | 2/2010 | Hamilton | 482/4 |
| 2010/0197471 | A1 * | 8/2010 | Hayes et al. | 482/140 |

* cited by examiner

*Primary Examiner* — Stephen Crow
(74) *Attorney, Agent, or Firm* — Frommer Lawrence & Haug LLP; Paul A. Levy

(57) ABSTRACT

A mat that can be used for the practice of yoga includes a curve-shaped design and strategically placed stitch markings to assist the user in producing a properly aligned position with each yoga pose or yoga posture. Both the shape enhancements and stitch markings can help create a technological and functional mat to help both novice and expert practitioners achieve better performance in their yoga practice.

9 Claims, 6 Drawing Sheets

EXERCISE MAT

This application claims priority to provisional application Ser. No. 61/070,423, filed Mar. 21, 2008, the entirety of which is incorporated herein by reference.

BACKGROUND

1. Field of the Invention

The invention relates to an exercise mat. In particular, the mat has a shape and indicia to improve the practice that focuses on the user's body alignment and positioning, as found, for an example, in yoga.

2. Description of Related Art

Yoga is the practice of a variety of asanas (postures) performed in a continuous manner or flow. This practice is often traditionally referred to as Hatha Yoga. This 5000 year old custom originates from India, and today has become the fastest growing sport in America; indeed, yoga practitioners have increased 136% since 2001 (MRI Market Study, 2006). There are various forms practiced, which include, but are not limited to: Vinyasa, Bikram, Iyengar and Ashtanga.

Yoga offers both mental and physical benefits through its postures and breath-control techniques. The postures help create strength, balance and poise. Some poses demand extreme balance and alignment. For the purposes of this application, the terms "postures" and "poses" are used interchangeably. Yoga postures are based and taught upon a stable foundation, the foundation being the particular parts of the body touching the floor or mat.

There are over one thousand yoga postures. Balance during postures requires a good foundation to maintain stability. A practitioner's height, flexibility, and level of experience are among the factors that can affect the placement of the body part(s) forming the stable foundation of the posture. Yoga poses are held for a reasonable length of time, sometimes one minute or more. A stable foundation forms the basis of balance for a yoga practitioner in simple poses as well as more complicated and challenging postures.

SUMMARY OF INVENTION

In a first embodiment, a mat for the purposes of alignment includes four sides, a shorter first side and a second side substantially parallel thereto, and a first lateral side and a second lateral side, the first and second lateral sides being curved inwardly. The first and second lateral sides are symmetrical about a vertical axis of the mat and the inward curvature of the first and second lateral sides combine to form a narrowest distance between the first and second lateral sides along a transverse axis of the mat.

In a second embodiment, a mat, includes a first end and a second end substantially parallel thereto, and a first lateral side and a second lateral side, the first and second lateral sides curved inwardly. The mat is symmetrical about a longitudinal axis of the mat and asymmetrical about a transverse axis of the mat, the inward curvature of the first and second lateral sides combine to form a narrowest distance between the first and second lateral sides along the transverse axis of the mat. A first overlap portion is formed on an upper surface of the mat at the first end, and a second overlap portion is formed on a bottom surface of the mat at the second end.

In a third embodiment, a mat includes a top mat portion having a top mat portion first end substantially parallel to a top mat portion second end, a top mat portion first lateral side and a top mat portion second lateral side, and a top mat portion elongated slot through the top mat portion, the top mat portion first and second lateral sides curved inwardly; and a bottom mat portion having a bottom mat portion first end substantially parallel to a bottom mat portion second end, a bottom mat portion first lateral side and a bottom mat portion second lateral side and a bottom mat portion elongated slot through the bottom mat portion, the bottom mat portion first and second lateral sides curved inwardly, the bottom mat portion assembled to the top mat portion to form a first overlap portion at the first end of the top mat portion and second overlap portion at the second end of the bottom mat portion. The top mat portion and the bottom mat portion are substantially the same size and shape and are each symmetrical about a respective top mat longitudinal and a bottom mat longitudinal axis and asymmetrical about a respective top mat transverse axis and a bottom mat transverse axis.

Further, the mat includes top mat first indicia on an upper portion of the top mat portion, the upper portion being above the top mat transverse axis; top mat second indicia on a lower portion of the top mat portion, the lower portion being below the top mat transverse axis; bottom mat first indicia on an upper portion of the bottom mat portion, the upper portion being above the bottom mat transverse axis, the bottom mat first indicia substantially the same as the top mat first indicia; and bottom mat second indicia on a lower portion of the bottom mat portion, the lower portion being below the bottom mat transverse axis, the bottom mat second indicia substantially the same as the top mat second indicia. The bottom mat portion is assembled to the top mat portion top mat portion so the top mat transverse axis is aligned with a bottom mat transverse axis, the top mat first indicia is aligned with the bottom mat second indicia, and the top mat second indicia is aligned with the bottom mat first indicia. The inward curves of the respective top mat portion and bottom mat portion lateral sides combine to form a narrowest distance across the mat along the aligned transverse axes of the top mat and bottom mat.

In an implementation, the first and second indicia of the top and bottom mat portions are each an elongated slot through the respective top and bottom mat portions.

In a fourth embodiment, a mat includes a first lateral side and a second lateral side, the first and second lateral sides curved inwardly forming a narrowest distance between the first and second lateral sides, the first and second lateral sides being symmetrical about a longitudinal axis of the mat and asymmetrical about a transverse axis of the mat. The inward curves of the first and second lateral sides combine to form a narrowest distance between the first and second lateral sides along the transverse axis of the mat.

DETAILED DESCRIPTION

The present disclosure is directed to a mat that may be used for exercise or recreational activities. The mat may be used, for example, for Pilates, exercise, yoga or other activity where physical placement of a user's body on the mat may be significant.

Figure 1:
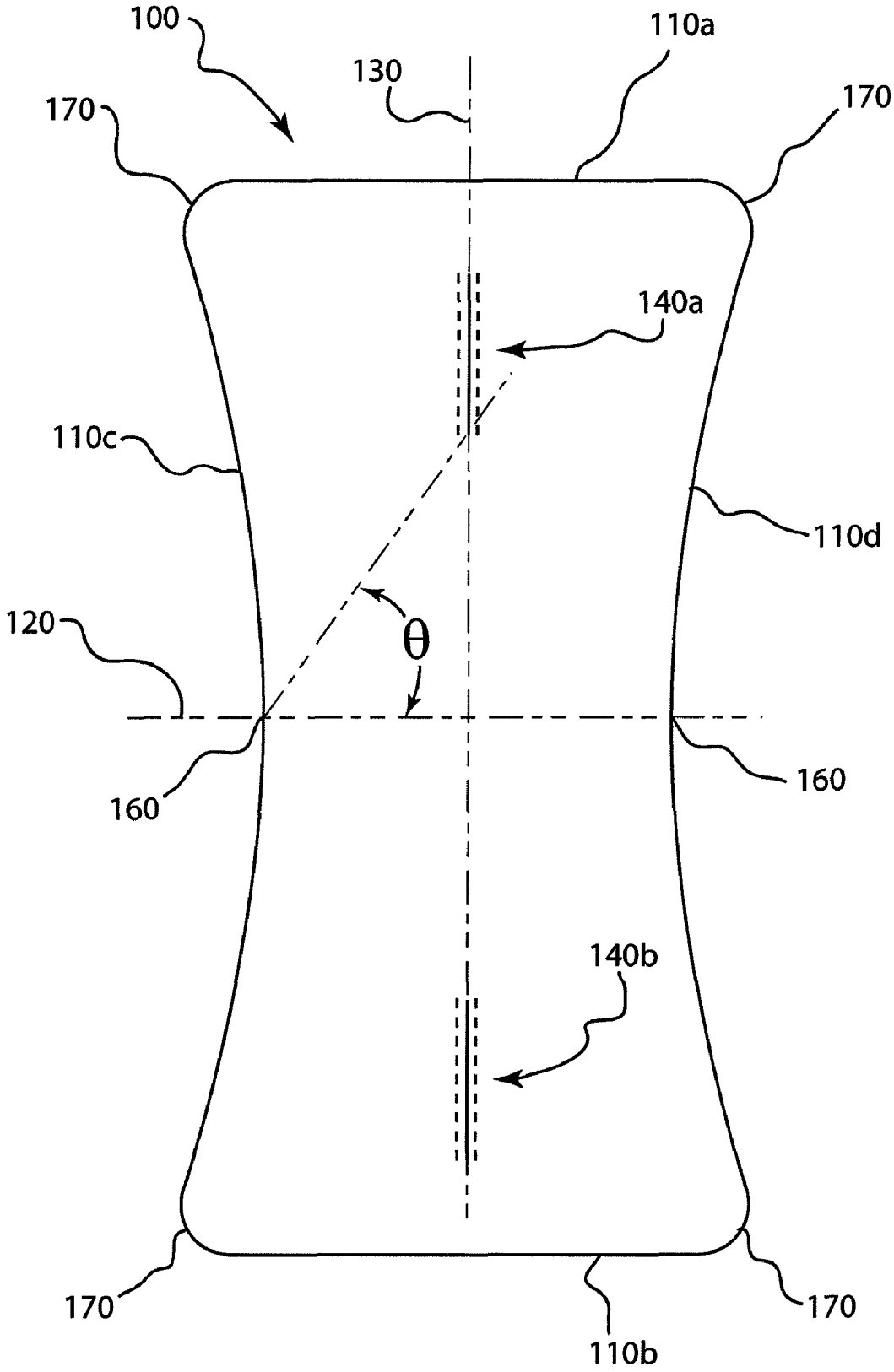
FIG. 1 is a mat according to the present invention.

FIG. 1 is a top plan view of a mat 100 according to an implementation of the present invention having sides 110*a*, 110*b*, 110*c*, 110*d* and indicia 140. Sides 110*a*, 110*b* are substantially parallel and form a first end and a second end, respectively, of the mat. Sides 110*c*, 110*d* are curved inwardly and form a first lateral side and a second lateral side, respectively, of the mat. Lateral sides 110*c*, 110*d* can be symmetrical about a horizontal, that is, transverse axis 120 of the mat and a mirror-image about a vertical, that is, longitudinal, axis 130 of the mat. The curve in each of lateral sides 110*c*, 110*d* combine to form a tapered waist 160 in the mat that has the narrowest portion along the transverse axis 120 of mat 100.

The mat can be marked by several longitudinal stitch markings 140*a*, 140*b*, which assist the user in aligning their hands (or feet or other body part(s)) depending on the pose or posture desired. Indicium 140*a* is provided on an upper portion of the mat and indicium 140*b* is on a lower portion of the mat. Indicia 140*a*, 140*b* can each be two lines of stitching each parallel to longitudinal axis 130 of mat 100 and symmetrical thereabout. Indicia 140*a*, 140*b* can be a mirror-image of one another about transverse axis 120 of the mat. In an embodiment, the two lines of stitching of each indicium 140 are no more than 6 centimeters apart and at least 1 (one) centimeter apart.

Indicium 140*a* can start at an angle, θ, from the transverse axis 120, at a datum point where the transverse axis intersects inwardly curved lateral side 110*c*. In an implementation, θ is in the range of 30 degrees to 70 degrees and preferably in the range of 40 degrees and 60 degrees and more preferably in the range of 45 degrees to 55 degrees. Indicium 140*a* can end at an angle θ in the range of 45 degrees to 85 degrees and preferably in the range of 55 degrees to 75 degrees and more preferably in the range of 60 degrees to 70 degrees.

Indicia 140*a*, 140*b* can be the parallel lines of stitching as described above. However, alternative indicia may be employed. Indicia 140*a*, 140*b* may be other stitching arrangements as shown in FIG. 6 or may be a through-hole as described in FIG. 5, below or other means of distinguishing an alignment.

When the mat is used for the practice of yoga, for example, the spatial relationship between the indicia and inwardly curved lateral sides 110*c*, 110*d* provide the practitioner/student with guidance as to body positioning for yoga poses and postures. The mat can also enable the practitioner to assess progress in proper body positioning by observing their body positioning in relation to the spatial relationship between the inwardly curved lateral sides, end sides, and the indicia. Moreover, the inwardly curved lateral sides aid the yoga practitioner using the mat to envision a desired body shape the practitioner wants, desires, or strives for.

The curved lateral sides produce a waist 160 or hourglass formation along the transverse axis of the mat as part of the overall mat design. Thus the transverse tapered middle section on either side of waist 160 provides a point of balance or reference for the user. Corners 170 where inwardly curved lateral sides 110*c*, 110*d* meet the end sides 110*a*, 110*b*, can be rounded to continue the curve-shaped flow of the mat. The spatial relationship of indicia 140*a*, 140*b* to the tapered middle section about waist 160 and end sides 110*a*, 110*b* provide a simple visual point of balance or reference for the yoga practitioner.

The simplicity of the present design has advantages over more complex yoga mat patterns that attempt to provide exact positioning of the practitioner's body. Complex designs may give a novice yoga practitioner the false sense that mere body positioning is all that is required to achieve advancement of their yoga practice. For an experienced practitioner, complex designs can be distracting to the physical and mental concentration of yoga practice. Yoga mats having excessive rectilinear markings or sides can provide a visual sight that may be adverse to the psychology and metaphysical mental state for which a yoga practitioner is striving. Moreover, markings for body placement on a rectilinear scale can imply that improvement in yoga practice is achieved in discontinuous, incremental steps. Such a mental construct is antithetical to yoga philosophy in which improvement may be measured along a continuous scale.

Yoga involves both the control of the mind and the body to achieve purification of the physical body as leading to the purification of the mind. Some yoga students may place an emphasis on the body through asana practice and be satisfied with the physical health and vitality yoga practice can develop. However, yoga achievement is inseparable from mental conditioning. Such mental conditioning may include abstentions, meditation, concentration, and abstraction. The mat of the present invention avoids rectilinear markings and sides and, instead, uses curvilinear relationships to enhance the yoga practitioner's focus on the non-physical aspects of yoga while not abandoning positional guidance to the yoga posture.

While the spatial relationship of the curved lateral sides forming the waist of the mat to the stitching and mat ends provides physical and spatial guidance to a practitioner, such relationships may not be evident or obvious to a non-practitioner who does not have understanding or skill in the art of yoga.

Figure 2:
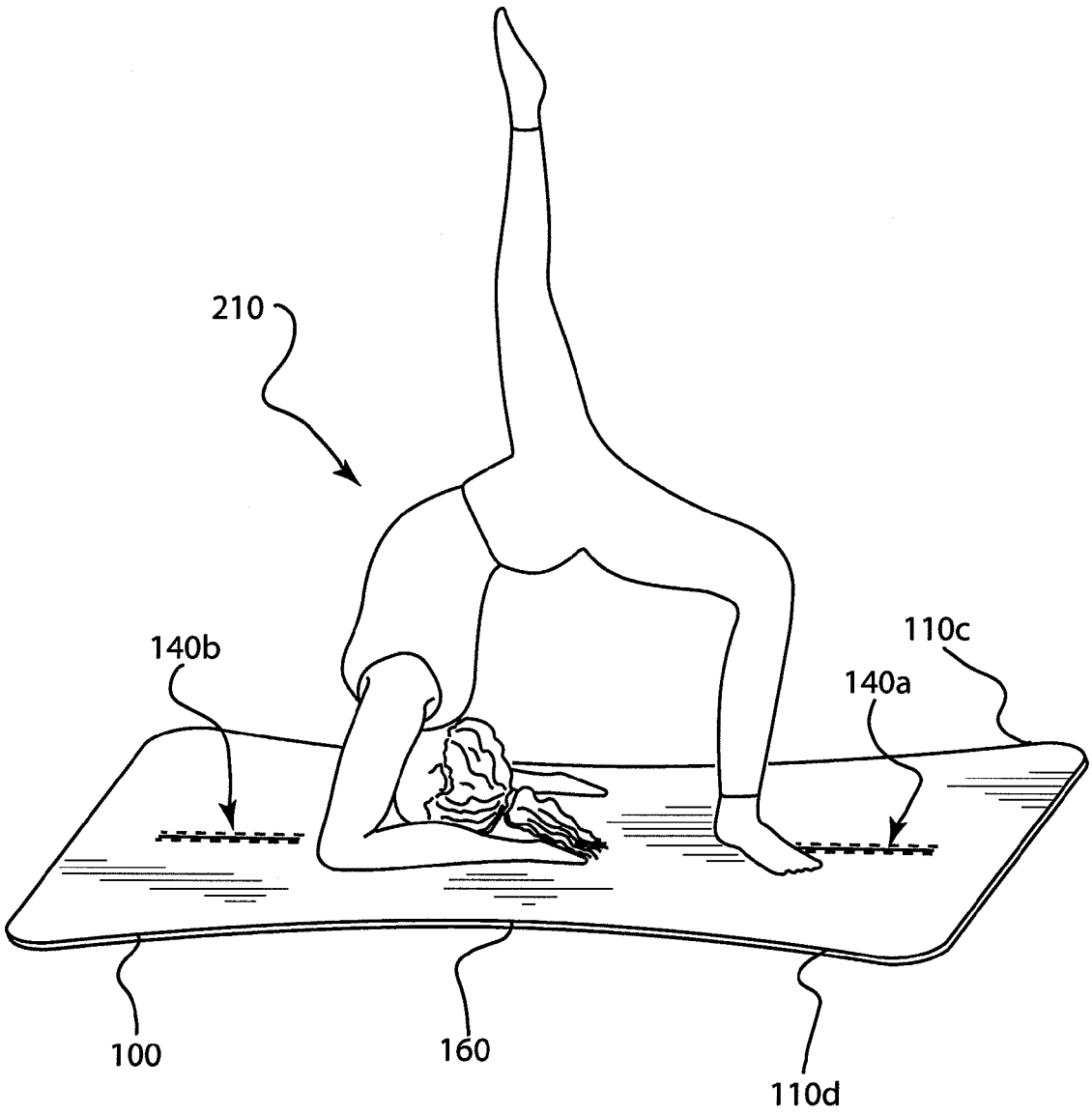
FIG. 2 is an illustration of a person performing a yoga posture on the mat of FIG. 1.

FIG. 2 illustrates a person 210 performing a yoga posture on an embodiment of the mat 100 of the present invention. The person can use both the curve-shaped lateral sides 110*c*, 110*d* on either side of waist 160 and the lower center longitudinal stitch markings 140*b* of the mat, which helps the practitioner to align their pose more properly to preferred yoga practice.

Figure 3A:
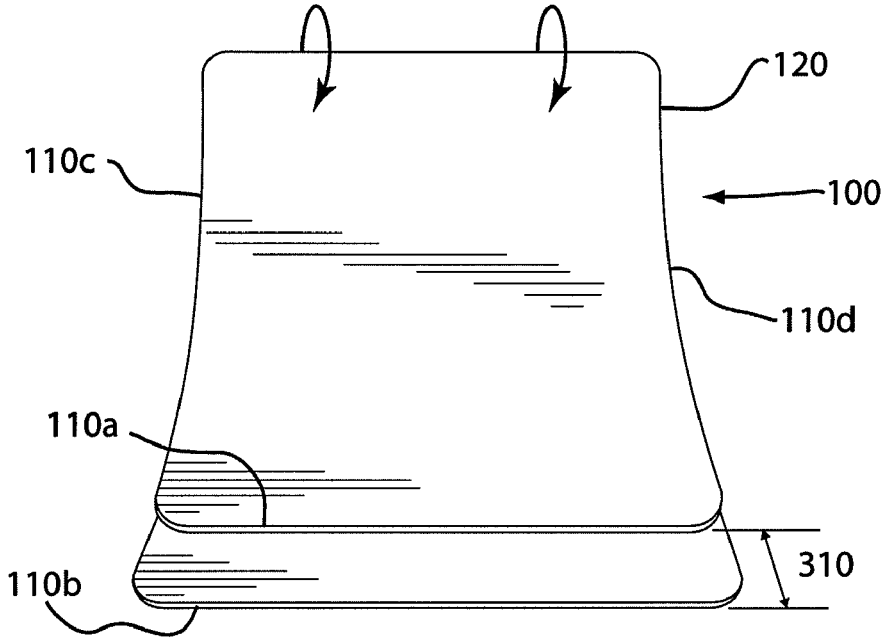
FIGS. 3A-3D is an illustration of a method of rolling up the mat of FIG. 1.
Figure 3B:
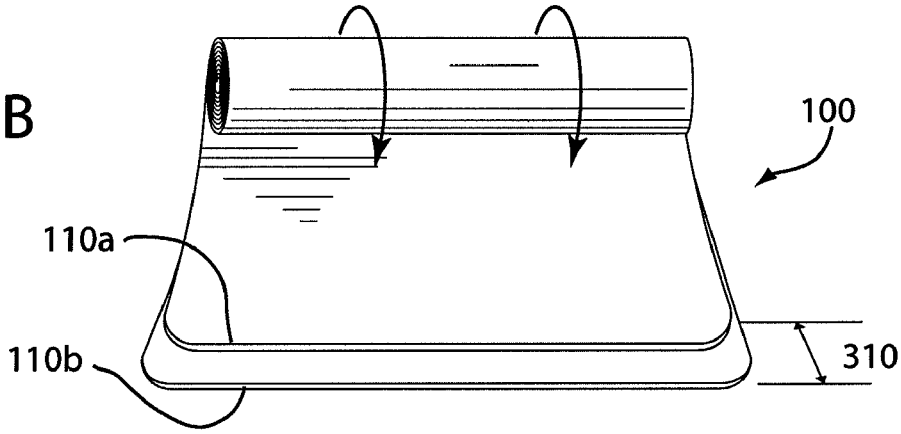
Figure 3C:
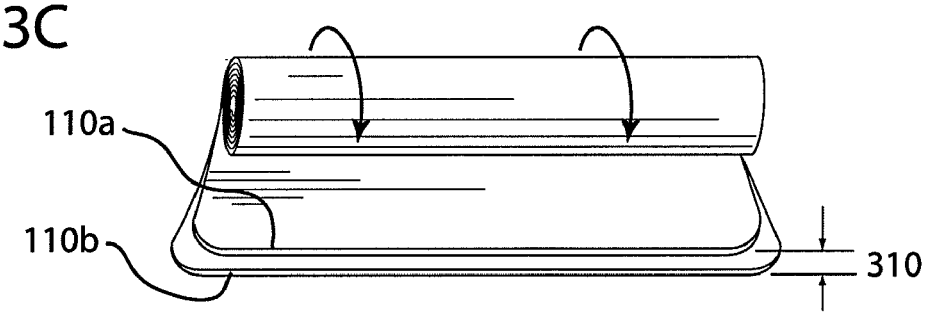
Figure 3D:
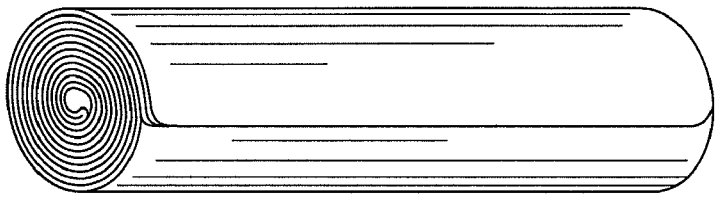

FIGS. 3A-3D illustrate mat 100 being rolled up, for example, for storage or transport. Because of the inwardly curved configuration of lateral sides 110*c*, 110*d*, the mat should be rolled up in the particular way shown. First the mat is folded at a location slightly off transverse axis 120 of the mat. That is, end sides 110*a*, 110*b* do not align after folding resulting in a predetermined amount of gap 310 between ends 110*a*, 110*b*. Next, the mat can easily be rolled up as shown in FIGS. 3B-3D and put away for future use. As the mat is rolled up, gap 310 decreases until end sides 110*a*, 110*b* are substantially aligned when the mat is completely rolled up as shown in FIG. 3D.

Figure 4:
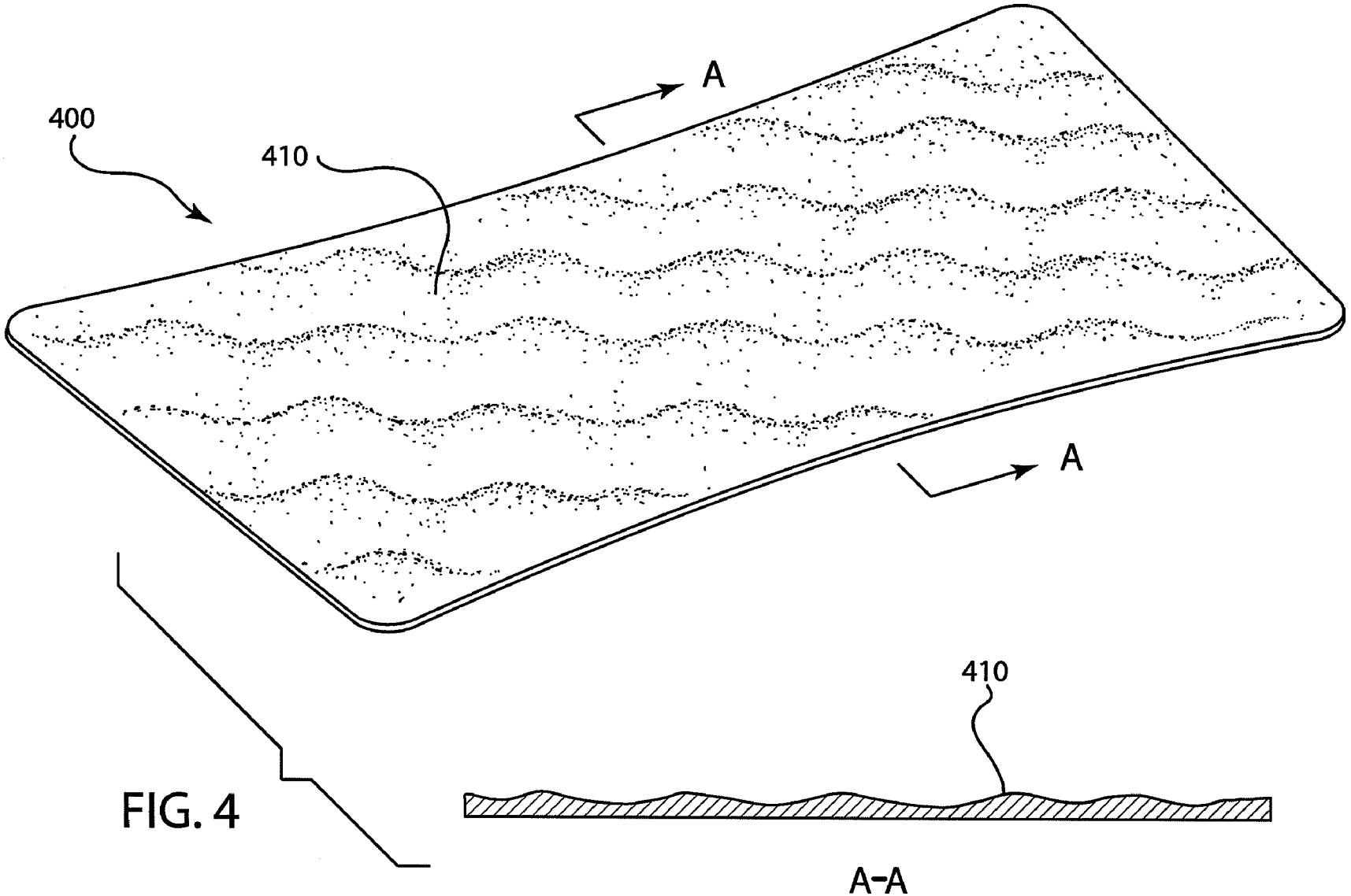
FIG. 4 is a profile of a mat according to one embodiment.

FIG. 4 is a mat 400 having a profile substantially as shown in section A-A. In the illustrated implementation, a top surface 410 of mat 400 has an uneven surface profile. In one embodiment, the surface of the mat can be an undulated plane as indicated in the profile A-A of FIG. 4. This undulated surface profile A-A is designed to enhance sensory stimulation in the user's hands, feet, or other body part upon contact, which can create more awareness between the grip of the hands or feet and the surface of the mat. This awareness can assist the user in creating a better platform in the execution of balancing postures.

Figure 7:
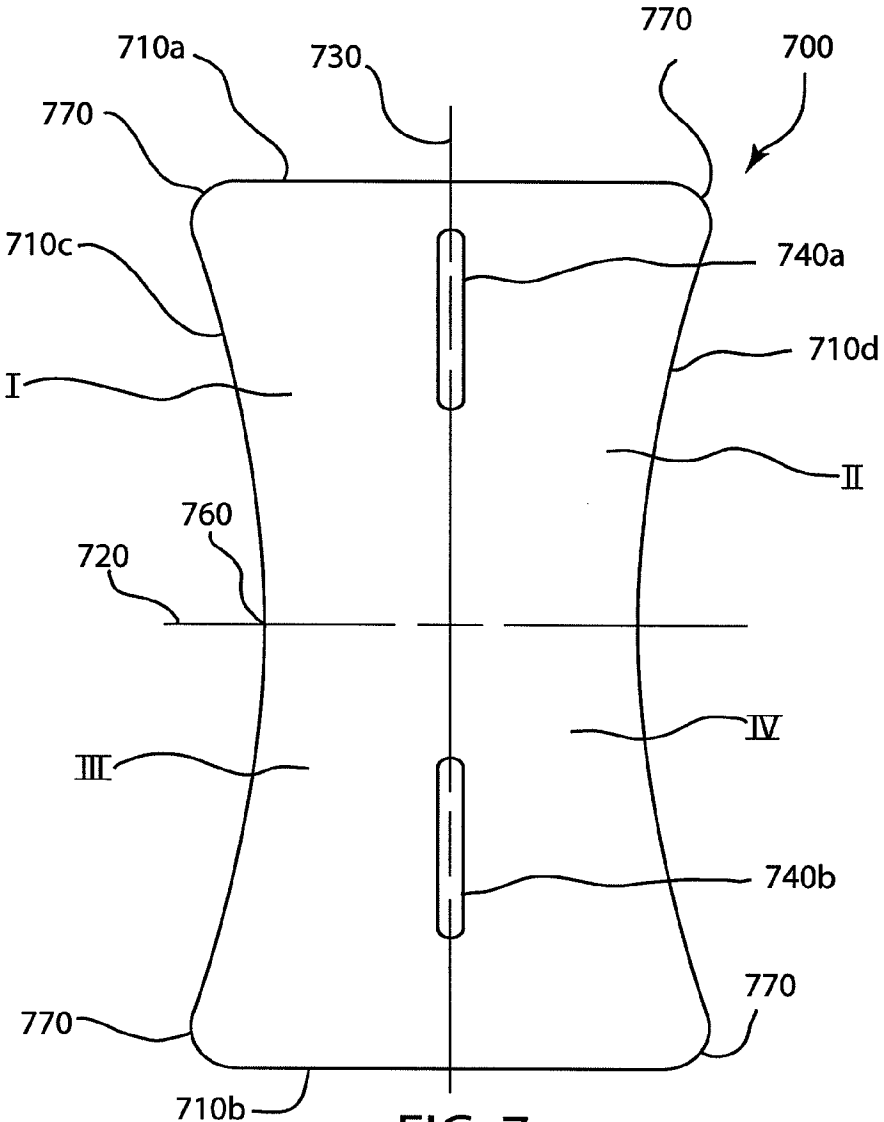
FIG. 7 is a mat that is asymmetrical about a transverse axis.

FIG. 7 illustrates a mat 700 that is symmetrical about a vertical, that is, longitudinal axis 730 and asymmetrical about a horizontal, that is, transverse axis 720. Mat 700 has sides 710*a*, 710*b*, 710*c*, 710*d* and indicia 740*a*, 740*b*. Indicia 740*a*, 740*b* are through-holes in the shape of an elongated slot, although alternative indicia may be used. In an embodiment, the width of elongated slot indicia 740 is less than 6 centimeters and more than 1 (one) centimeter. The length of elongated slot indicia 740 is constrained as described with respect to FIG. 1, above. Sides 710*a*, 710*b* are substantially parallel and form a first end and a second end, respectively, of the mat. Sides 710*c*, 710*d* are curved inwardly and form a first lateral side and a second lateral side, respectively, of the mat. The curve in each of lateral sides 710*c*, 710*d* combine to form a tapered waist 760 in the mat that has the narrowest portion along the transverse axis 720. The corners 770 where inwardly curved lateral sides 710*c*, 710*d* meet the end sides 710*a*, 710*b*, can be rounded to continue the curve-shaped flow of the mat.

Transverse axis 720 and longitudinal axis 730 conceptually divide the mat into four quadrants, I, II, III, IV. Mat 700 is symmetrical about longitudinal axis 730 and not symmetrical about transverse axis 720. Quadrant pairs I and II are symmetrical about the longitudinal axis. Similarly, quadrants III and IV are symmetrical about the longitudinal axis. Quadrants I and III are asymmetrical about the transverse axis. Similarly, quadrants II and IV are asymmetrical about the transverse axis. Thus, the distance from transverse axis 720 to first edge 710*a* is relatively shorter than the distance from transverse axis 720 to second edge 710*b*.

Figures 5A, 5B, 5C:
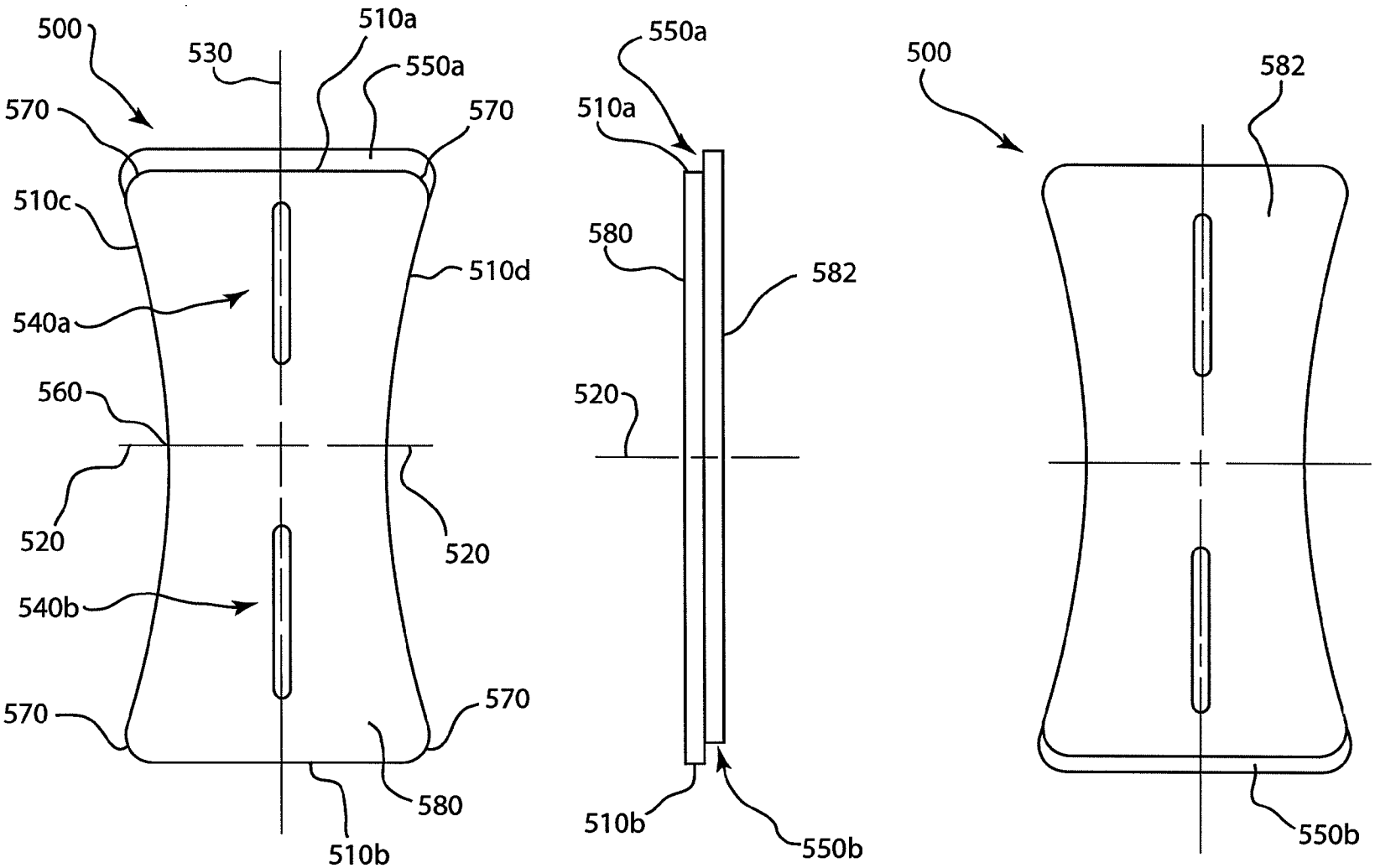
FIGS. 5A-5C is a mat having an overlap portion.
Figure 6:
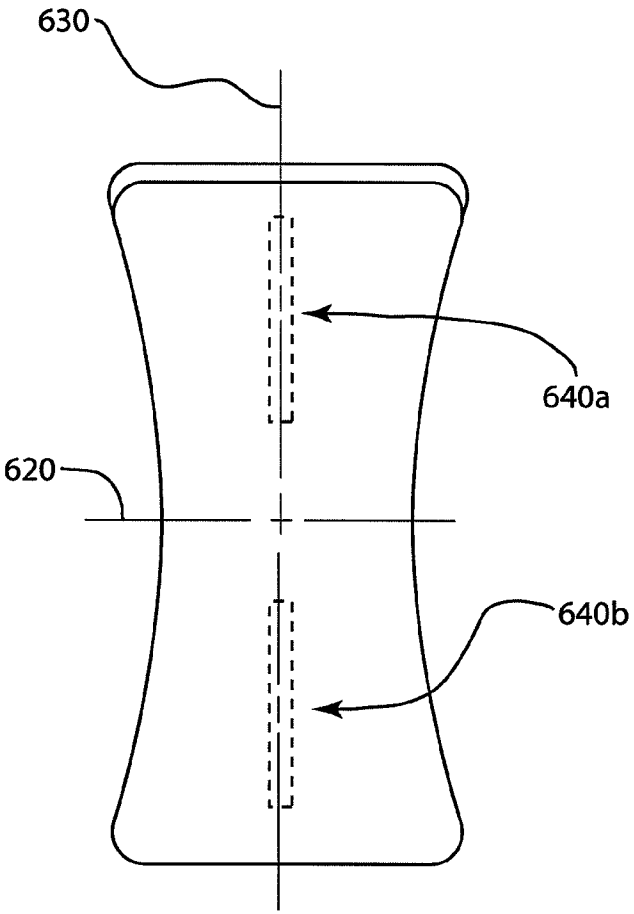
FIG. 6 is the mat of FIG. 5 having alternative indicia.

FIGS. 5A-5C illustrate a top, side, and bottom view, respectively, of a mat 500 having overlap end portions 550*a*, 550*b*. Mat 500 is comprised of a top mat portion 580 and a bottom mat portion 582 that have substantially the same shape and are similar to the mat described with respect to FIG. 7. That is, mats 580, 582 are symmetrical about a longitudinal axis 530 and asymmetrical about a horizontal, that is, transverse axis 520. For convenience, only top mat portion 580 will be described, bottom mat 582 being substantially the same. Top mat 580 has sides 510*a*, 510*b*, 510*c*, 510*d* and indicia 540. Indicia 540*a*, 540*b* are through-holes in the shape of an elongated slot, although the invention is not limited to a particular form of indicia. In an embodiment, the width of elongated slot indicia 540 is less than 6 centimeters and more than 1 (one) centimeter. The length of elongated slot indicia 540 is constrained as described with respect to FIG. 1, above. Sides 510*a*, 510*b* are substantially parallel and form a first end and a second end, respectively, of the top mat. Sides 510*c*, 510*d* are curved inwardly and form a first lateral side and a second lateral side, respectively, of the top mat. Lateral sides 510*c*, 510*d* can be a mirror-image about a vertical, that is, longitudinal axis 530 of the top mat. The curve in each of the lateral sides 510*c*, 510*d* combine to form a tapered waist 560 in the top mat that has the narrowest portion along the transverse axis 520 of mat 500. The corners 570 where inwardly curved lateral sides 510*c*, 510*d* meet the end sides 510*a*, 510*b*, can be rounded to continue the curve-shaped flow of the mat. Top mat 580 is not symmetrical about a transverse axis 520 of the mat. That is, the distance from transverse axis 520 to first edge 510*a* is relatively shorter than the distance from transverse axis 520 to second edge 510*b*.

Top mat 580 is assembled to bottom mat 582 by aligning the tapered waist of each and having the shorter distance from the transverse axis to the first edge of the top mat rest over the longer distance from the transverse axis to the top edge of the bottom mat. When so aligned, the respective transverse axes of top mat 580 and bottom mat 582 are aligned as are the respective longitudinal axes thereof. When so assembled, the assembly provides overlap portions 550*a*, 550*b* as shown in FIG. 5B. Moreover, when assembled, indicia in the top and bottom mats also will align over one another to create a through-hole in the assembled mat 500. Also, the perimeter of the resultant assembled mat is symmetrical about both the aligned traverse and longitudinal axes. A center support, not shown, such as a cotton mesh, may be assembled between the top and bottom mats.

Overlap end portions 550 present another visual curve to the practitioner. Overlap end portions 550 continue the curvilinear relationship already established between through-hole indicia 540*a*, 540*b* and curved lateral sides 510*c*, 510*d* as described above with respect to the mat of FIG. 1. When used for the practice of yoga, for example, the spatial relationships of the curved surfaces can combine to both provide a user with positional locators for hands (or feet) during a yoga pose as well as a measure of positional improvement along the continuity of those relationships. Moreover, overlap end portion 550 can provide a visual focal point for the practitioner and establish an orientation for the yoga mat by distinguishing between end sides 510*a* and 510*b*. These features may provide the user/practitioner with additional confidence in their alignment, and further allow them the freedom "to be in" or fully experience the pose. Consequently, a user/practitioner may have less apprehension and self-doubt that can hinder proper yoga practice.

FIG. 6 illustrates an alternative stitching 640*a*, 640*b* in the shape of an elongated rectangular box symmetrical around longitudinal axis 630 and located, respectively, in an upper part, above a horizontal, that is, transverse axis 620, and a lower part, below the transverse axis. Stitching 640*a*, 640*b* fill a portion of the upper part and lower part, respectively, of the mat and are mirror-images of one another around transverse axis 620. In an embodiment, the width of elongated rectangular stitching indicia 640 is less than 6 centimeters and more than 1 (one) centimeter. The length of elongated rectangular stitching indicia 540*a*, 540*b* is constrained as described with respect to FIG. 1, above.

Other embodiments are within the scope of the following claims.

What is claimed is:

1. A mat for the purposes of alignment, consisting essentially of:

a first end and a second end substantially parallel thereto, and a first lateral side and a second lateral side, the first and second lateral sides being curved inwardly, wherein the first and second lateral sides are symmetrical about a vertical axis of the mat and the inward curvature of the first and second lateral sides combine to form a narrowest distance between the first and second lateral sides along a transverse axis of the mat;

first indicia on an upper portion of the mat, the upper portion being above the transverse axis of the mat; and second indicia on a lower portion of the mat, the lower portion being below the transverse axis of the mat;

wherein the mat is sized to accommodate a human and aid a yoga practitioner to properly align the practitioner's body during yoga postures, and wherein the first indicia and the second indicia are located substantially about the vertical axis such that the first and second indicia start at an angle in the range of 30° to 70° to the transverse axis at a point where the transverse axis intersects the first inwardly curved lateral side and end at an angle in the range of 45° to 85°.

2. The mat of claim 1, wherein the first indicia and the second indicia are mirror images of one another about the transverse axis.

3. The mat of claim 2, wherein a top surface of the mat has an undulating profile.

4. The mat of claim 2, wherein the first indicia and the second indicia are stitching.

5. The mat of claim 4, wherein the stitching of the first indicia is in the shape of two equal length lines parallel to a longitudinal axis of the mat, the stitching extending less than half a length of the mat.

6. The mat of claim 4, wherein the stitching of the first indicia is in the shape of rectangular box symmetrical around a longitudinal axis of the mat, the length of the rectangular box being less than half a length of the mat.

7. A mat, consisting essentially of:

a first lateral side and a second lateral side, the first and second lateral sides curved inwardly forming a narrowest distance between the first and second lateral sides, the first and second lateral sides being symmetrical about a longitudinal axis of the mat and asymmetrical about a transverse axis of the mat, wherein the inward curves of the first and second lateral sides combine to form a narrowest distance between the first and second lateral sides along the transverse axis of the mat;

first indicia on an upper portion of the mat, the upper portion being above the transverse axis of the mat; and second indicia on a lower portion of the mat, the lower portion being below the transverse axis of the mat;

wherein the mat is sized to accommodate a human and aid a yoga practitioner to properly align the practitioner's body during yoga postures, and wherein the first indicia and the second indicia are located substantially about the longitudinal axis such that the first and second indicia start at an angle in the range of 30° to 70° to the transverse axis at a point where the transverse axis intersects the first inwardly curved lateral side and end at an angle in the range of 45° to 85°.

8. The mat of claim 7, wherein the first indicia is symmetrical about the longitudinal axis of the mat; and wherein second indicia is symmetrical about the longitudinal axis of the mat and substantially the same as the first indicia, the first and second indicia symmetrical about the transverse axis of the mat.

9. The mat of claim 8, wherein the first and second indicia are each an elongated slot through the mat.

* * * * *